United States Patent [19]

Erwin

[11] 4,377,287

[45] Mar. 22, 1983

[54] BOARD GAME APPARATUS

[76] Inventor: John R. Erwin, 232 N. Arden Blvd., Los Angeles, Calif. 90004

[21] Appl. No.: 213,387

[22] Filed: Dec. 5, 1980

[51] Int. Cl.[3] ..... A63F 3/04

[52] U.S. Cl. ..... 273/252

[58] Field of Search ..... 273/251, 252, 254

[56] References Cited

U.S. PATENT DOCUMENTS

| | | | |
|---|---|---|---|
| 952,997 | 3/1910 | Sanderson | 273/254 |
| 4,052,072 | 10/1977 | Beal | 273/254 |

FOREIGN PATENT DOCUMENTS

| | | | |
|---|---|---|---|
| 1526893 | 4/1968 | France | 273/252 |
| 2280410 | 1/1976 | France | 273/254 |
| 709543 | 5/1954 | United Kingdom | 273/252 |

*Primary Examiner*—Richard J. Apley

*Assistant Examiner*—Carl Moy

*Attorney, Agent, or Firm*—Larry F. Gitlin

[57] ABSTRACT

Apparatus for playing a board game based on airplane flight concepts and geographical relationships among countries of the world. Spaces are provided on a board for the movement of symbolic elements representing airplanes, with the number of spaces moved determined by chance, subject, however, to specific instructions affecting the movement of the symbolic elements, as determined by the directions of certain of the spaces on the board. At least four (4) stacks of cards are provided, with each card providing a specific flight destination or good or bad information affecting the flight movement on the board, either towards or from the numerous airports located on the board. The object of the game is for a player to be the first to move his symbolic element or airplane to the total number of airports agreed upon by the players before the game starts.

6 Claims, 1 Drawing Figure

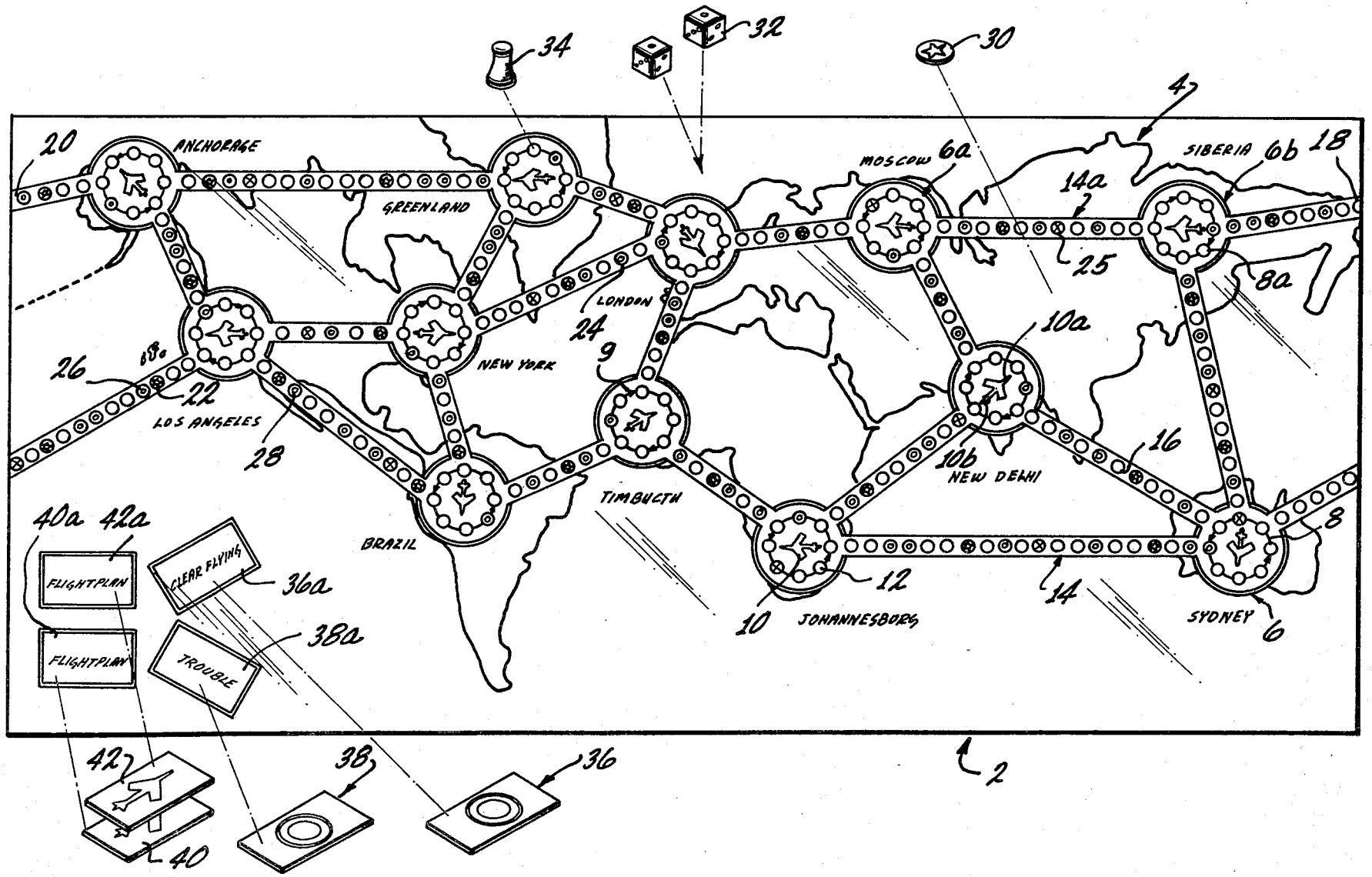
SIBERIA
SYDNEY
MOSCOW
NEW DELHI
JOHANNESBURG
LONDON
TIMBUCTU
NEW YORK
GREENLAND
BRAZIL
ANCHORAGE
LOS ANGELES
CLEAR FLYING
TROUBLE
FLIGHTPLAN
FLIGHTPLAN

BOARD GAME APPARATUS

BACKGROUND OF THE INVENTION

1. Field of the Invention

The present invention relates generally to the field of games of the type which are intended to be played by a plurality of players on a board with movable pieces in association with said board.

Game boards with movable pieces and chance controlled games are numerous and well known with their objects to promote various mental skills in addition to providing entertainment. All such games accomplish these purposes to a varying degree.

However, there is always a need for even more skillful, creative and enjoyable games, without being unduly complicated.

2. Description of the Prior Art

Games employing geographical locations have been popularized in the past, one of the most popular of such games being the board game RISK. In RISK, the object is for the player to maneuver his armies in order to occupy as many countries as possible, ultimately to achieve dominance over the entire world and, of course, over the other players in the game. The first player to accomplish this objective wins.

Although enjoying a degree of popularity over the years, games such as RISK having an obviously military theme are often found to be extremely unpopular with people who detect the very idea of war. Because of this, the educational value in the geographical lesson to be learned is substantially inhibited.

The board game apparatus of the present invention incorporates not only a map of the world, which provides a valuable insight into the geographical relationship among the various countries of the world, but also information and concepts pertaining to air travel among a number of such countries.

There has thus existed prior to the present invention a need for a game whereby people of all ages may be educated not only in world geography, but also in the experiences and certain aspects of the airline industry, particularly to methods of air travel in and out of the various airports of the world.

The advantages and distinctions of the present invention over the prior art will become more clearly evident in the following disclosure.

SUMMARY OF THE INVENTION

It is an object of the present invention to provide an entertaining, skillful game that may be easily learned and played by a wide variety of people. More specifically, the game employs chance controlled, with choices, movable pieces that are moved on a game board in competition with one or more players.

The game board comprises a map of the world and paths of travel thereon representing flight paths between airports of different countries. Each airport is represented by a generally circular region within which the flight path extends into the taxi pattern around that airport. Within the region of each airport is disposed a pictorial representation of an airplane, including nose, tail, and wing sections.

Along the various flight paths and taxi patterns around and between the airports are specially designed and/or colored spaces which, when landed on by a player's playing piece, will affect a player's progress in the game.

At the start of the game, each player selects a playing piece and places his piece on an unoccupied airport on the board. The players then roll the dice, the player scoring the highest number starting first. Each player then selects a flight plan card which designates the airport to which that player must then proceed. At his turn, each player rolls the dice and proceeds, according to the number indicated on the die, to move his playing piece along the paths of travel to the airport designated on the previously selected flight plan card.

On the way to the airport the player must move his playing piece past or upon spaces specially designated to affect the forward progress of the piece. For example, certain spaces require the player to stop or reverse movement of a playing piece, e.g. lose one turn or return to the last designated or occupied airport. Other spaces, however, will indicate the selection of one of a number of cards which contain instructions that will affect the movement of that or another player's playing piece.

The ultimate goal of the game is for one player to be the first to reach or "fly" to the number of airports agreed upon by all of the players before the start of the game.

The advantage and distinctions of the present invention over the prior art will be more clearly evident as the disclosure proceeds, especially those relating to the educational and entertainment advantages of the game.

BRIEF DESCRIPTION OF THE DRAWING

The accompanying drawing is a perspective of the means of the present invention which may be employed to play the game, including the board, movable elements, the die, groups of cards and associated playing pieces.

DESCRIPTION OF THE PREFERRED EMBODIMENTS

The apparatus of the present invention consists of a game board 2 made of any suitable material, e.g. cardboard, wood or plastic, and being generally rectangular in configuration. The playing surface of game board 2 is provided with a map of the world 4 and located at various points on map 4 are a plurality of airport zones 6 which are interconnected by paths of travel or flight paths 14.

Each airport zone 6 includes a pictorial representation of an airplane 10 having a nose section 10*a* and a tail section 10*b*. Surrounding each airplane 10 is a taxi pattern 8. Also, between airport zones 6 and surrounding each airplane 10 are a plurality of smaller zones 8*a*. These zones may consist of blank or safe zones 16, flying merit zones 22, clear flying zones 26, disaster zones 25, trouble zones 28, and lose one turn zones 24.

Game board 2 also includes spaces which are designated for separate stacks of cards. For example, spaces 40*a*, 42*a* are locations, respectively, for two stacks of Flight Plan cards, 40, 42. Space 36*a* is the location for the stack of Clear Flying cards 36 and space 38*a* is the location for the stack of Trouble cards 38. The significance of these cards will be explained in more detail below.

The apparatus of the present invention also consists of a die 32. Die 32 is unique with respect to the form of the indicia on the faces of each respective dice. Instead of the usual one (1) to six (6) indicia on the faces of each dice, die 32 consists of faces having zero (0) to a maximum of only three (3) indicia. For example, a throw of the die 32 may produce a zero (0) roll or a roll as high as six (6). In some situations, however, individual preferences may require that the number of such indicia be modified.

Each player is also provided with a movable playing piece 34 which may be designed in any manner permitting unrestricted movement on the game board 2. Playing piece 34 is intended to represent and to be used by each player in moving along flight path 14 and taxi pattern 8 from one airport to another.

Flying merit game pieces 30 generally are of a circular configuration and include a representation of a star thereon. These pieces may be used at various times during the playing of the game, under specified conditions, to accelerate a player's movement to the previously designated flight plan airport.

The object of the game is to be the first player to "fly" to the number of airports agreed upon by all of the players before the game begins. Once the number of airports are agreed upon, the players must roll the die 32 to determine the order in which they will take their turns, the player rolling the highest number starting first. Each stack of cards 36, 38, 40 and 42, are then shuffled and placed face down on their corresponding designated locations 36*a*, 38*a*, 40*a* and 42*a*. Each player, at his turn then places his respective playing piece 34 on an unoccupied airport and draws a Flight Plan card from stack 40 or 42, referring to the selected card to determine the airport to which he must fly first.

For example, the first player may begin the game by placing his playing piece 34 upon the Moscow airport 6*a*. From stack 40 he selects a Flight Plan card which designates Siberia 6*b* as the first airport to which he must fly or move his playing piece 34. Ideally, the first player will want to use the shortest path of travel 14*a* to accomplish this objective.

Also, at the beginning of the game, each player may be provided with one or more flying merits 30 which signify that his flight performance has been competent. When a predetermined number of flying merits is accumulated by any one player, that player may then, if he wishes, surrender his flying merits in return for an immediate advance to the objective airport.

To advance towards the objective airport, a player must leave the airport his playing piece 34 occupies via the nose 10*a* of the plane 10, follow the direction of the arrows 9 of the taxi pattern 8 until he decides which of the flight paths leading from the airport 6 he will choose in order to move towards the objective airport.

When rolling the die 32 to determine the extent of the movement of playing piece 34 in the airport 6 along the taxi pattern 8, a player is required to roll both dice, but may only move his playing piece 34 according to the amount shown on only one of the dice. If, for example, both dice are blank, i.e. indicate zero (0), then the player may not move his playing piece 34 at all. On the other hand, if one dice shows a zero (0) and the other a two (2), the player has no option and must move his playing piece two spaces.

To move a playing piece 34 along flight path 14, a player is required to roll both dice. However, the player may choose the amount shown on either dice or the total amount shown on both.

If a player begins his turn from outside an airport 6 and intends to move into the airport, he may choose the amount shown on both dice or, alternatively, the amount shown on one of them.

If a player begins his turn from inside airport 6 and intends to move outside the airport along the flight path 14, he must choose only the amount shown on one of the dice, not the total of the two combined.

Along flight path 14 and taxi pattern 8 are a number of spaces or zones, most of which are blank, but some of which indicate or signify special instructions which will affect the forward progress of a player's playing piece 34 when landed on. For example, clear flying zone 26 requires that the player draw a card from the stack of clear flying cards 36. The card drawn will instruct the player on the direction or in the manner to move his playing piece 34. Generally, clear flying cards 36 will give instructions to assist the player in accelerating towards his objective airport.

When a player's playing piece 34 lands on trouble zone 28, the player must draw from a stack of trouble cards 38 to determine the extent to which his forward progress will be inhibited. In some cases the cards will instruct that the player reverse the movement of his playing piece 34 a prescribed number of spaces. In other situations, a selected trouble card will instruct that the player move his playing piece 34 back to the airport from which the present flight originated.

The lose one turn zone 24 is self-explanatory.

When landing on a flying merit zone 22, a player will receive one flying merit. Although the rules may be modified, when a player has received six (6) flying merits 30, he may immediately proceed to his immediate airport objective. However, in return for this privilege, the player must surrender all of his accumulated flying merits.

When a player lands on a disaster zone 25, he is required to remove his playing piece 34 to the airport from which his present flight originated. Also, the player must surrender all of his accumulated flying merits 30.

To occupy or land on an airport 6, a player must move his playing piece 34 onto the taxi pattern 8 from the flight path 14 and follow the direction of the arrows 9 until the playing piece 34 is able to enter the airplane 10 from the tail section 10*b*. Landing on the airplane 10 must be accomplished by an exact roll of the die 32, otherwise the player must continue to move the playing piece 34 around the taxi pattern 8 until the exact roll of the dice achieves the intended objective.

Once a player has landed upon the airplane 10 of the objective airport 6, as aforesaid, he has successfully completed the trip and on his next turn must then select a new flight plan card from the stack of cards 40 or 42 to determine the location of the next airport to which he must fly.

When moving his playing piece 34 along the flight path 14, a player may never reverse his direction.

If a clear flying 36 or trouble card 38 instructs a player to move his playing piece 34 upon zones 22, 24, 25, 26, and 28, the player is considered neutral and is not affected by the instructions normally associated with any of such zones.

When landing upon another player's playing piece 34 while moving along a flight path 14, the playing piece 34 already occupying that zone must immediately retreat to the airport from which his current flight plan originated.

A player may also leave the game board 2 at either end thereof, e.g. path 20, and then re-enter at the opposite end, e.g. path 18, to continue his flight.

While a preferred embodiment has been illustrated in detail, with some variations mentioned, for purposes of illustration and the advantages of the details, it is contemplated that further embodiments, modifications and variations are possible according to the broader aspects of the present invention, all as defined by the spirit and scope of the following claims:

What is claimed is:

1. A board game apparatus for play by two or more players comprising:

a plurality of movable elements, at least one of said elements to be provided each player;

means for each player, when his turn comes up, to develop by chance a numerical factor;

a game board displaying a representation of a map of the world;

a plurality of individually defined zones upon said board and within the parameters of said map, each of said zones containing a central region comprising a pictorial representation of an airplane and a peripheral region comprising a peripheral loop of spaces surrounding said central region, said airplane having a front portion and a back portion such that for a player to complete the movement of said movable element from said peripheral region into said central region, said movable element must enter said central region through said back portion of said airplane and, for a player to complete the movement of said movable element from said central region into said peripheral region, said movable element must exit said central region through said front portion of said airplane;

a plurality of path means extending to and from within said zones constituting a path of travel for said movable elements, the number of path means to be travelled by each element at the turn of its player being determined by the numerical factor developed by said player upon using said means to develop said numerical factor; and, a portion of said path means consisting of a plurality of indicator means;

a plurality of first cards each of which provides information instructing immediate or enabling future forward progress in the movement of said movable element over said path means, one of said cards being selected upon the movement of said movable element onto one of said path means consisting of a corresponding said indicator means said movement having been determined by the numerical factor developed by said player by using said means to develop said numerical factor;

means to develop said numerical factor;

a plurality of second cards, each of which provides information instructing the reversal or the stoppage of the forward movement of said movable element over said path means, one of said cards being selected upon the movement of said movable element onto one of said path means consisting of a corresponding said indicator means, said movement having been determined by the numerical factor developed by said player by using said means to develop said numerical factor;

a plurality of third cards, each of which contains a reference to one of said zones, one of said cards being selected by a player at the start of said game and thereafter whenever said movable element is intended to be moved to one or more of said other zones;

a plurality of game pieces which, when accumulated to a pre-determined number, require said player accumulating said number of said pieces to move said player's movable element immediately to the zone referred to on said player's last selected card of said plurality of third cards.

2. The board game apparatus of claim 1 wherein said pieces may be accumulated or surrendered by said player according to the instructions in a selected card of said plurality of second or third cards or by one or more of said indicator means.

3. The board game apparatus of claim 1 wherein at least two said game pieces are provided each player at the start of said game.

4. The board game apparatus of claim 1 wherein the means to develop by chance a numerical factor comprises two dice, each of said dice constituting a cube, whereby each face of the cube consists of zero, one, two or three indicia.

5. The board game apparatus of claim 4 wherein the numerical factor developed by one of said die is used to determine the number of said path means onto which said movable element is moved when said element begins movement from said path means located inside one of said zones.

6. The board game apparatus of claim 4 wherein the numerical factor developed by one or both said dice is used to determine the number of said path means onto which said movable element is moved when said element begins movement from said path means located outside one of said zones.

* * * * *